United States Patent [19]

Deutsch

[11] Patent Number: 4,692,376

[45] Date of Patent: Sep. 8, 1987

[54] MICROPOROUS COATING FOR SOLID MEMBERS TO REDUCE STRESS, WEAR AND FATIGUE AT LIQUID INTERFACES

[76] Inventor: Daniel H. Deutsch, 141 Kenworthy Dr., Pasadena, Calif. 91105

[21] Appl. No.: 936,128

[22] Filed: Dec. 1, 1986

[51] Int. Cl.[4] ..... B32B 3/26

[52] U.S. Cl. ..... 428/315.5; 428/317.9; 428/319.1; 428/328; 428/329; 428/418

[58] Field of Search ..... 428/312.2, 312.6, 312.8, 428/315.5, 315.7, 315.9, 317.9, 319.1, 328, 329, 418

[56] References Cited

U.S. PATENT DOCUMENTS 4,567,096 1/1986 Piltingsrud et al. ..... 428/315.5
4,576,874 3/1986 Spengler et al. ..... 428/319.1

FOREIGN PATENT DOCUMENTS 2130244 5/1984 United Kingdom ..... 428/312.2

*Primary Examiner*—William J. Van Balen
*Attorney, Agent, or Firm*—Lyon & Lyon

[57] ABSTRACT

A microporous coating applied to solid members to protect them from stress, erosion, pitting, fatigue and failure when in contact with turbulent liquids. The coating is applied on the solid member as a liquid but becomes dry and microporous when the coated, solid member is dried and cured.

13 Claims, No Drawings

MICROPOROUS COATING FOR SOLID MEMBERS TO REDUCE STRESS, WEAR AND FATIGUE AT LIQUID INTERFACES

BACKGROUND OF THE INVENTION

Solid members moving through or in contact with moving liquids are subject to stresses and strains. These conditions are aggrevated when the fluid flow is turbulent as opposed to laminer. With turbulent flow, substantial negative pressure at localized areas can develop which can result in cavitation. Voids or bubbles are formed in the liquid under such conditions which then collapse as positive pressure is returned. When the bubble collapse occurs on a solid surface it results in a large transfer of momentum from the liquid to a very small area of the solid. The collapse of these bubbles occurs with such force that solid members subjected to this force experience extreme localized stress, fatigue, corrosion, and erosion as well as pitting and flaking and, in extreme cases, outright rupture of the solid member.

Some well known examples of solid members that encounter liquids under the aforesaid conditions are pipes, pumps, propellers in water, the hull of a ship, the hydraulic drive on an automobile, hydraulic machinery of all kinds, the submerged members of a hydrofoil vessel, and water-driven turbines.

Surface coatings such as oxides, hydroxides, or carbonates form on some metallic surfaces in contact with water and protect the under metal from certain attack. However, these coatings do not form on all metals and not all liquids will cause them to form. Also, these protective coatings can be ruptured by a negative pressure on the surface as well as by the transient high positive pressure produced during the collapse of a cavitation bubble on the solid surface.

Additional deleterious effects on solid members caused by contact with turbulent fluids are:

1. The rupture of the liquid under high negative pressure, i.e. cavitation, can disrupt the molecules in the liquid thereby producing highly reactive free radicals and ions which can then chemically attack the solid member.
2. Repeated alternating of high negative and positive pressure exerted on the solid members, particularly metalic members, cause them to flex and eventually fail through fatigue, crystalization or brittleness.
3. Corrosion and erosion noted above increases the friction between the liquid and the solid member and hence lowers the overall efficiency of the system.

A primary method of coping with the various problems associated with turbulent fluid flow is to reduce the relative velocity between the solid member and the liquid. This, however, negates the very purpose that the system was constructed to achieve. As an example reducing the revolutions per minute (r.p.m.) of a propeller on a ship will reduce the deleterious effects of the turbulent liquid but only at the expense of reducing the ship's speed with its attendant additional costs.

A second method for coping with the deleterious effects of turbulent liquids is to replace the deteriorated solid members as they loose their effectiveness through corrosion and erosion. This is expensive, causes down time, and when the deterioration of the solid member is not detected in time, complete failure of the solid member can result.

SUMMARY OF THE INVENTION

The present invention is directed to a microporous coating which protects solid members in contact with turbulent liquids from the stress and wear caused by the motion of such liquids and improves the durability and performance of the solid members. This is accomplished by promoting disassociation of the liquid at the solid surface without the build-up of high negative pressures.

It has been true that cavitation at a liquid-solid boundry has required high negative pressures to generate the cavitation voids. The damaging effect from the callapse of such voids at the solid surface can be mitigated by reductions in the formation of such high negative pressures in the first place. A coating of the present invention employing a layer of fine porosity, non-wetted material can provide a multiplicity of gaseous bubbles or voids at low negative pressure thereby preventing the build up of high negative pressures and the associated deleterious effects noted above.

Accordingly, it is an object of the present invention to provide an improved surface structure for devices subject to the effects of cavitation. Other and further objects and advantages will appear hereinafter.

DETAILED DESCRIPTION OF THE PREFERRED EMBODIMENT

A solid member having a microporous surface of the present invention exposed to a liquid in turbulent flow tends to generate a large number of very small voids or bubbles at the surface which expand into the adjacent liquid as a foam. This foam is carried away from the solid member into the liquid as it forms. When the liquid fills the voids in the foam caused by the collapse of voids or bubbles therein, it does so in a location physically removed from the surface of the solid member or, if on the surface of the solid member, with much less force. Thus, the high impact of the collapsing voids or bubbles on the solid surface with its attendant corrosion, erosion, and pitting can thereby be reduced or eliminated.

For example, if a ship's propeller were treated with this microporous coating on those surfaces which are subjected to contacting a liquid under turbulent flow conditions, while other operating conditions were unchanged, the deleterious effects generated by the liquid would be greatly reduced or totally eliminated. Further, by retaining the desirable hydrodynamic shape originally built into the propeller the power efficiency would remain constant rather than decrease, as does the efficiency of an uncoated propeller when corroded and eroded by contact with turbulent liquids. Therefore, higher operating speeds for a given rate of fuel consumption are possible. Also, lower maintenance costs and less down time would result.

As a further example, hydrofoil vessels provide an effective and efficient means for the rapid transport of people and perishable cargos across water at much higher speeds than the conventional passenger-cargo ships. A major unsolved problem associated with hydrofoil vessels is the rapid degradation of those surfaces exposed to turbulent liquids. By covering those exposed, solid members of the hydrofoil vessel with the instant microporous coating, the degradation of the exposed surfaces could be reduced or eliminated.

Generally, the microporous coating fall within the range of from 0.001 mm to 30 mm thick. However, the preferred thickness is from 0.1 mm to 5 mm. The average pore diameter of the microporous coating may be in the range from about $10^{-6}$ mm to 1 mm, with $10^{-5}$ mm to 0.01 mm being the preferred diameter range. Also, the pore density may range from about 10 per square cm to $10^{13}$ per square cm with $10^4$ per square cm to $10^{11}$ per square cm being the preferred range of pore density.

The microporous coating of this invention can have either a uniform average pore diameter from the bottom side of the coating, which is in contact with the solid member, to the top side of the coating, which contacts the liquid, or the coating can possess a graded average pore diameter. The graded average pore diameter has smaller pore diameter near the solid member and larger pore diameter where the coating contacts the liquid.

The specific microporous coating to be used on a certain type of material making up the solid member will depend on the individual circumstances as may be easily determined by those skilled in the art. Factors such as the temperature range of the contacting fluid, the chemical nature of the contacting fluid and the composition of the solid member will determine the specific formulation of the microporous coating. The microporous coating should not be wettable by the liquid that it encounters.

The application of such coatings may advantageously be limited to areas of hulls, propellers, impellers, planes and the like where high negative pressures are anticipated. It is possible to group liquid-solid boundries into two groups.

Region I, where the instantaneous pressure of the liquid, normal to the surface of the solid member is positive, and greater than the vapor pressure of the liquid, and Region II, where the instantaneous pressure of the liquid, normal to the surface of the solid member is negative, or positive but less than the varpor pressure of the liquid.

Region I constitutes a dynamically stable system and its behavior is reasonably well understood and predictable. Region I is generally characterized by laminar flow.

Region II constitues an unstable or potentially dynamically unstable system and its behavior is not very well understood or predictable in detail. Region II is characterized by turbulance and cavitation in the liquid.

The following are examples of coatings for various solid surfaces. It will be apparent to one skilled in the art that the formulation will vary depending upon the material that the solid member is made of, the composition of the liquid contacting the solid member, and the operating conditions such as temperature and pressure. However, the basic principles disclosed herein will have application beyond the examples herein discussed.

EXAMPLE 1

A well cured sample of a thermosetting epoxide resin (General Mills Corporation, Versamid 125/Araldite 6010, 40:60) is reduced in size to pass a 20 mesh screen in a hammer mill. This coarsely pulverized resin is ground to a very fine powder in a ceramic ball mill. This finely powered epoxide resin is then classified in a cyclone separator and the 0.02 to 0.1 micron sized particles are collected separately.

100 parts by weight of the 0.02 to 0.1 micron range epoxide resin particles is mixed with 100 parts by weight of toluene, an organic solvent, in a centrifuge tube and then the mixture is centrifuged at 1000× gravity for 10 minutes. The contents of the centrifuge tube is then gently stirred to suspend the cured epoxide resin particles, and 15 parts by weight of a mixture of uncured Versamid 125/Araldite 6010, in a 40:60 ratio is added with stirring.

The mixture is then applied with a brush to the areas of a clean, bronze propeller which will encounter Region II conditions. The coating is dried and cured in the air at 90° F. for 20 days. The microporous coating of epoxide resin is approximately two to three mm thick after drying.

EXAMPLE II

Alumna powder is classified in a cyclone separator and the 0.05 to 0.2 micron sized particles are collected separately.

100 parts by weight of the 0.05 to 0.2 micron sized alumina powder is mixed with 100 parts by weight of methyl ethyl ketone in a centrifuge tube and the mixture is centrifuged at 500×gravity for five minutes. The mixture is gently stirred until the solid is suspended and then 20 parts by weight of a mixture of an uncured epoxide resin, Versamid 125/Araldite 6010, in a 50:50 ratio, is added with stirring.

The mixture is then sprayed on the areas of a clean, bronze propeller which will encounter Region II conditions. The spray coated propeller is dried and cured at 100° F. for 15 days. The resultant microporous coating is approximately 1 to 2 mm thick.

Thus, an improved surface for regions where cavitation and large negative pressures are experienced is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A surface coating for areas of a solid member which are subject to high negative pressure in a liquid, comprising a porous outer layer of material affixed to the solid member which is non wetted by the liquid and has an average pore diameter in the range of about $10^{-6}$ mm to 1 mm.

2. The surface coating of claim 1, wherein said average pore diameter is in the range of about $10^{-5}$ mm to $10^{-2}$ mm.

3. The surface coating of claim 1, wherein said porous layer has a pore density in the range of about 10 per square centimeter to $10^{13}$ per square centimeter.

4. The surface coating of claim 1 wherein said porous layer has a pore density in the range of about $10^4$ per square centimeter to $10^{11}$ per square centimeter.

5. The surface coating of claim 1 wherein said porous layer has a thickness in the range of $10^{-3}$ mm to 30 mm.

6. The surface coating of claim 1 wherein said porous layer has a thickness in the range of from $10^{-1}$ mm to 5 mm.

7. The surface coating of claim 1 wherein said material is non wetted by water.

8. The surface coating of claim 1 wherein said average pore size is smaller near the solid member and larger near the outer surface of said porous layer.

9. The surface coating of claim 1 wherein said coating is prepared from an uncured thermosetting epoxy resin, alumina powder, and an organic solvent.

10. The surface coating of claim 9 wherein said organic solvent is a ketone.

11. The surface coating of claim 10 wherein said organic solvent is methyl ethel ketone.

12. The surface coating of claim 9 wherein there are 100 parts by weight of alumina powder, 100 parts by weight of methyl ethel ketone and 20 parts by weight of uncured epoxy resin.

13. The surface coating of claim 9 wherein the particle size of said alumina powder is within the range of from about 0.05 to 0.2 microns.

* * * * *